US007387323B1

(12) United States Patent
Minnette et al.

(10) Patent No.: US 7,387,323 B1
(45) Date of Patent: Jun. 17, 2008

(54) CARRIER FOR PAINT CAN OR OTHER CONTAINER HAVING A BAIL

(75) Inventors: Jeffery Minnette, Evansville, IN (US); Randall Julian, Spurgeon, IN (US)

(73) Assignee: Sunbeam Packaging Services, Evansville, IN (US)

( * ) Notice: Subject to any disclaimer, the term of this patent is extended or adjusted under 35 U.S.C. 154(b) by 141 days.

(21) Appl. No.: 11/372,489

(22) Filed: Mar. 9, 2006

Related U.S. Application Data

(60) Provisional application No. 60/661,092, filed on Mar. 11, 2005.

(51) Int. Cl.
*B65D 25/28* (2006.01)

(52) U.S. Cl. ..... 294/32; 294/27.1; 220/756; 220/759; 220/763

(58) Field of Classification Search ..... 294/15, 294/27.1, 32, 145, 26; 220/756, 759, 762–764; 16/425, 426; 248/210, 211, 311.2
See application file for complete search history.

(56) References Cited

U.S. PATENT DOCUMENTS 932,306 A * 8/1909 Miller ..... 222/467
2,353,555 A * 7/1944 Gore ..... 220/700
4,053,131 A * 10/1977 Francis ..... 248/211
5,482,339 A * 1/1996 Chishko, Jr. ..... 294/27.1
5,584,520 A 12/1996 Miemeier
5,806,709 A 9/1998 Marshall, II
5,938,513 A 8/1999 Slepikas et al.
5,947,319 A 9/1999 Sinski
6,102,458 A 8/2000 Scace
D456,578 S 4/2002 Smith et al.
6,450,364 B1 9/2002 Nam
6,694,966 B1 2/2004 Britton
6,783,103 B2 8/2004 Salani
6,829,800 B2 12/2004 Roebuck
2002/0125385 A1 9/2002 Tweed

* cited by examiner

*Primary Examiner*—Dean J Kramer
(74) *Attorney, Agent, or Firm*—Camoriano and Associates; Theresa Fritz Camoriano

(57) ABSTRACT

A carrier for carrying a can with a bail has a stepped ramp to engage with the bail of the can and secure the can to the carrier. The carrier includes a comfortable hand grip. In order to use the carrier, the user may place the front face of the carrier against the side of the can, with the hooked bottom portion of the carrier engaging the bottom edge of the can, slide the bail downwardly along the rear face of the carrier, passing over stepped ramps on the rear face until the can is tightly sealed against the hooked bottom portion of the carrier, and then grasp the hand grip on the carrier and lift the carrier to pick up the can.

9 Claims, 4 Drawing Sheets

CARRIER FOR PAINT CAN OR OTHER CONTAINER HAVING A BAIL

This application claims priority from U.S. Provisional Application Ser. No. 60/661,092, filed on Mar. 11, 2005, which is hereby incorporated herein by reference.

BACKGROUND

The present invention relates to containers such as paint cans, which have a bail. When carrying a paint can, the bail on the can tends to cut into the hand and cause pain or discomfort.

SUMMARY

The present invention provides a carrier designed for quick and easy attachment and removal from a can while allowing easy access to the contents of the can, as well as providing better control over the can and a more comfortable grip than the existing wire handle or bail.

The carrier is generally similar to the one described in U.S. Pat. No. 5,584,520, which is hereby incorporated herein by reference. However, this carrier has a stepped ramp to engage the bail of the paint can. The stepped ramp is used to tighten the carrier against the can for stability.

DETAILED DESCRIPTION

Figure 1:
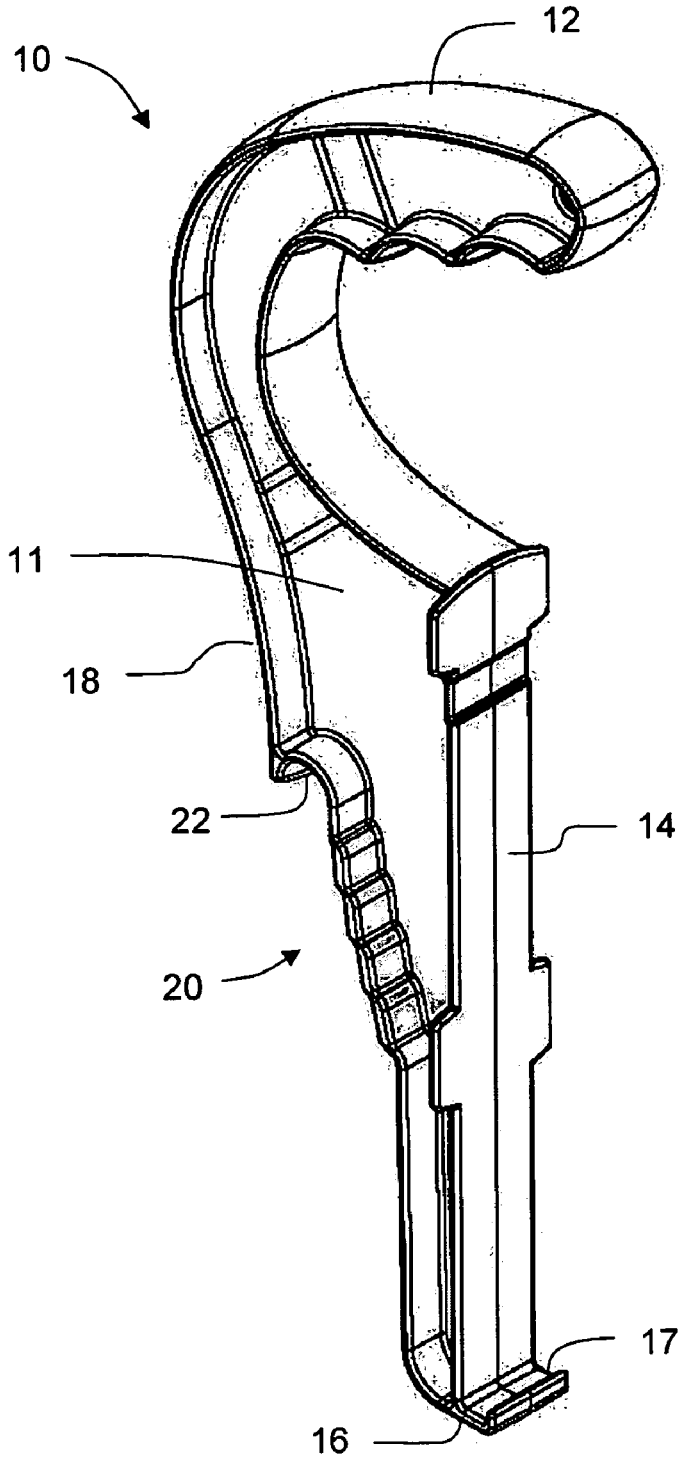
FIG. 1 is a perspective view of one embodiment of a carrier made in accordance with the present invention.
Figure 2:
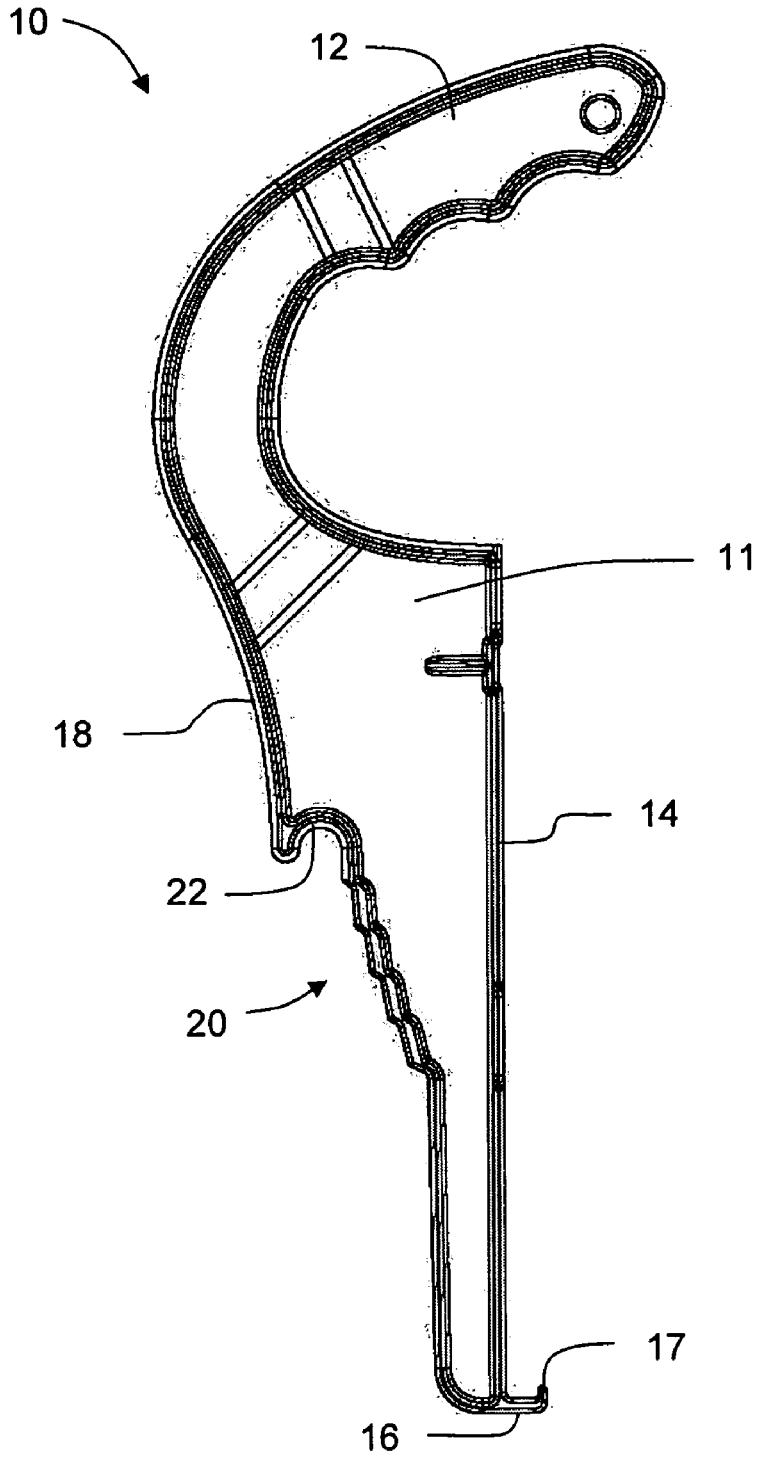
FIG. 2 is a side view of the carrier of FIG. 1.

FIGS. 1-6 show one embodiment of a carrier 10 made in accordance with the present invention. The carrier 10 includes a hand grip portion 12 at the top of the carrier, a body portion 11 including a substantially vertical, flat front face portion 14 that faces the can, and an L-shaped support lip 16 projecting outwardly and upwardly from the front side 14 near the bottom of the body 11. The hand grip portion 12 is generally C-shaped, defines a plurality of wide, arcuate surfaces to receive a person's fingers, and projects above the flat front face portion 14.

The support lip 16 includes a lip portion 17 that projects upwardly a short distance, so the bottom edge of the can is received on the support lip 16 between the upwardly-projecting lip portion 17 and the front 14 of the carrier body.

Figure 3:
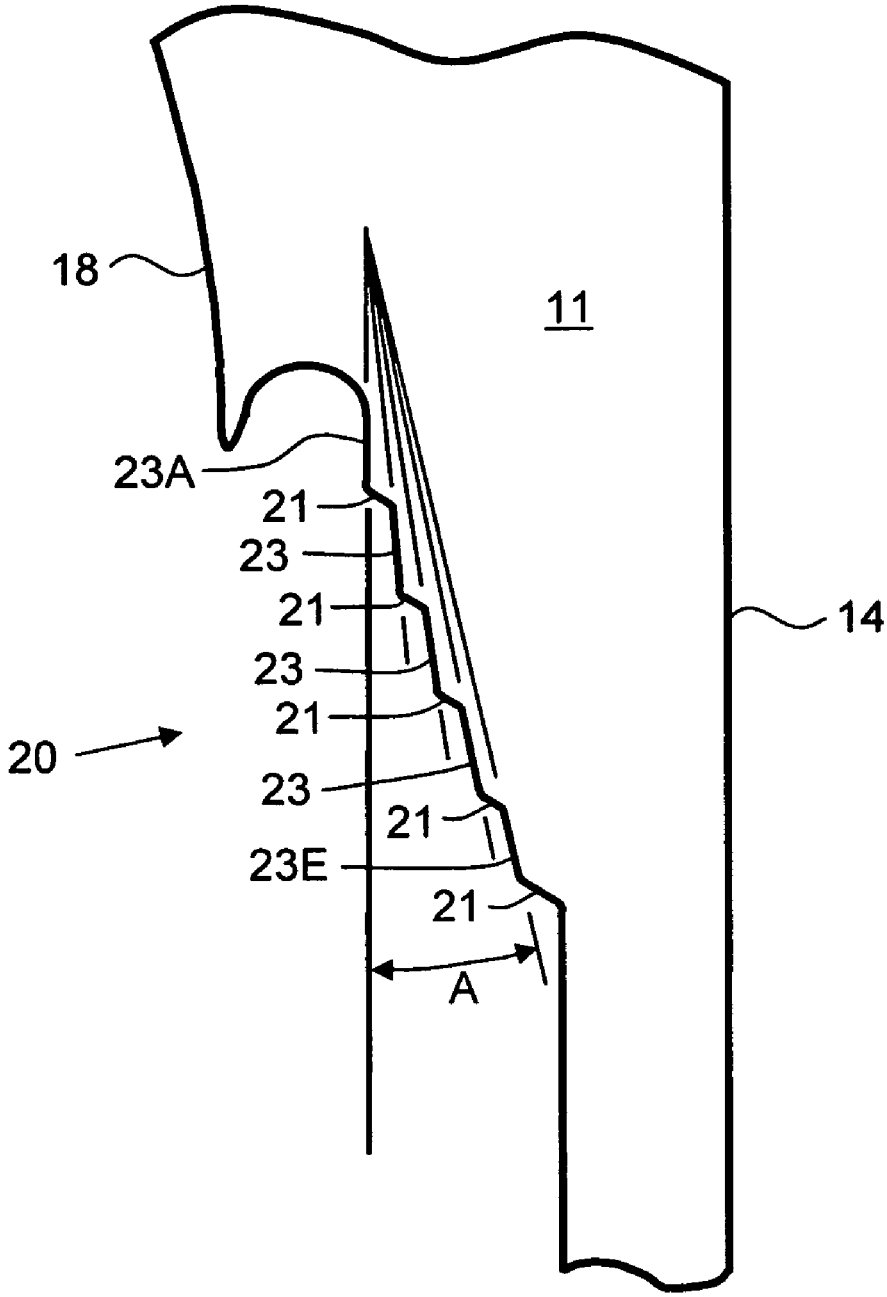
FIG. 3 is an enlarged broken away schematic side view of the carrier of FIG. 1.

On the rear side 18 of the body 11 is a bail catch surface 20 including a stepped ramp, which terminates at an inverted U-shaped recess 22, which is located more rearwardly than any of the steps 21 and serves as a stop for the bail, in the event it were to slip off of the steps 21. As best shown in FIG. 3, each of the steps 21 on the ramp is angled slightly downwardly from rear to front. Each of the risers 23 between the steps 21 lies at a different angle, with the top riser 23A being nearly vertical and each riser below it being at a progressively greater angle to the vertical until the bottom riser 23E lies at an angle A of approximately 15 degrees to the vertical. The bail catch surface 20 is progressively closer to the front surface 14 from the top of the carrier body to the bottom of the carrier body. Each step 21 defines a bail engagement position. The angles for the steps 21 and risers 23 of the stepped ramp were designed for optimum interaction with a can having a wire bail. The angles allow the stepped ramp 20 to securely engage the bail during use, but also allow the bail to be disengaged from the ramp 20 with nominal effort (for easy removal).

Figure 6:
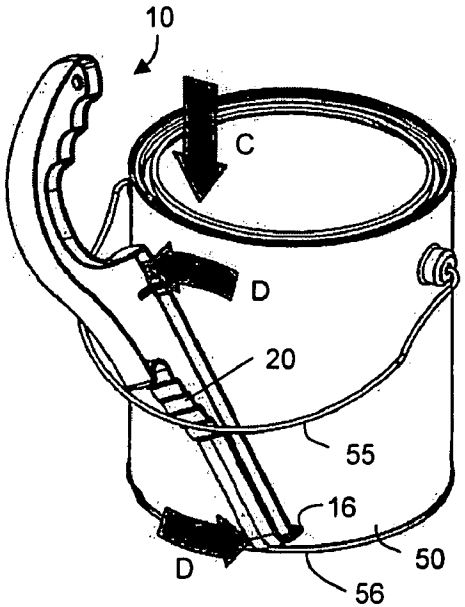
FIG. 6 is a view of the carrier of FIG. 1 as it is being removed from the can.
Figure 5:
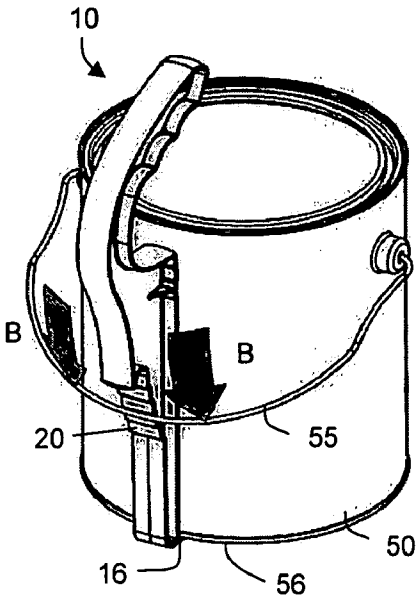
FIG. 5 is a view of the carrier of FIG. 1 being tightened onto the can.
Figure 4:
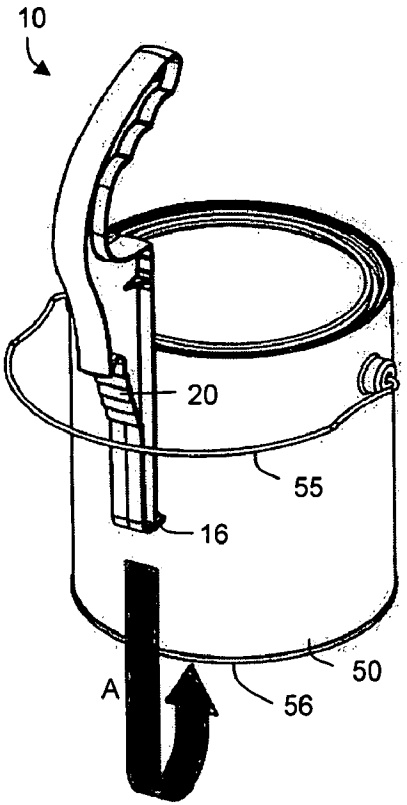
FIG. 4 is a view of the carrier of FIG. 1 as it is being installed on a can.

FIGS. 4-6 show the carrier 10 in use with a paint can 50 having a wire bail 55. FIG. 4 shows the carrier 10 in the first step of installation. As denoted by arrow A, the carrier 10 is slid down between the bail 55 and the can 50, with the front face of the carrier 10 facing the side of the can 50, until the support lip 16 is below the bottom edge 56 of the can 50. Then the carrier 10 is moved up and toward the can 50 until the bottom edge 56 of the can rests on the support lip 16.

FIG. 5 shows the carrier 10 in the second step of installation. As denoted by arrows B, the wire bail 55 is pivoted downwardly, passing along the bail catch surface 20 and gradually pressing the bottom edge 56 of the can 50 tighter against the support lip 16 of the carrier 10, until it engages the step 21 which tightens the can 50 against the lip 16. The carrier 10 now is secured to the can with at least a portion of the front face 14 (shown in FIG. 2) abutting the side of the can 50. The wire bail 55 acts like a spring, and its spring tension keeps the carrier 10 secured to the can 50.

FIG. 5 shows the carrier 10 as it is being removed from the can 50. The wire bail 55 is first disengaged from the stepped ramp by pushing the bail 55 upwardly along the step 21 with which it was engaged until the bail 55 slides off of that step 21, and the tension is relieved. Since the steps 21 are angled slightly upwardly from front to back (or downwardly from back to front) as shown best in FIGS. 2 and 3, it is relatively easy to slide the bail 55 along the step 21 to relieve the tension. Once the bail is disengaged, the carrier 10 is removed by pushing it downwardly as denoted by arrow C until the support lip 16 disengages from the bottom edge 56 of the can 50, and then rotating the carrier 10 sideways as denoted by arrows D. Then the carrier 10 can be lifted up from between the bail 55 and the can 50, removing it from the can 50.

One advantage of the stepped ramp on the bail catch surface 20 is that it allows for bending or distortion of the bail over time. If the carrier is used with the same can for a prolonged period of time, the wire bail may start to conform to that particular position on the stepped ramp, reducing the tension in the wire bail, and yielding a loose connection between the carrier and the can. If that happens, the bail can be moved a step lower on the carrier to restore the tension. Further, the stepped ramp allows for slight variations in cans. For instance, the carrier may be properly secured to one can at a particular step position, while another can is properly secured at a different step position.

It will be obvious to those skilled in the art that modifications may be made to the embodiment described above without departing from the scope of the invention as claimed.

What is claimed is:

1. A carrier for use with a can having a bail, comprising:

a carrier body having a top, a bottom, a front, and a rear, wherein said front defines a substantially flat vertical face portion;

a support lip projecting forward from said front near the bottom of said carrier body for supporting the bottom of the can;

a bail catch surface projecting rearwardly from the rear of said body for retaining the bail of the can, said bail catch surface being progressively closer to said front surface as one progresses from the top of said carrier body to the bottom of said carrier body and defining a plurality of steps and risers; and a hand grip near the top of said carrier body.

2. A carrier for use with a can having a bail as recited in claim 1, wherein each of said steps is angled slightly downwardly from rear to front.

3. A carrier for use with a can having a bail as recited in claim 2, wherein said risers are angled slightly rearwardly from bottom to top;

said support lip is L-shaped, including a forwardly-directed portion and an upwardly-directed portion for hooking around the bottom edge of a can:

said hand grip is generally C-shaped and defines a plurality of arcuate recesses for receiving a person's fingers; and wherein said bail catch surface further comprises an inverted U-shaped recess located above and rearwardly of said steps.

4. A carrier for use with a can having a bail as recited in claim 1, wherein each of said risers is angled slightly rearwardly from bottom to top.

5. A carrier for use with a can having a bail as recited in claim 4, wherein the rearward angle of the risers decreases from bottom to top, so that the top riser is substantially vertical.

6. A carrier for use with a can having a bail as recited in claim 5, wherein the bottommost riser is angled approximately 15 degrees rearwardly from vertical.

7. A carrier for use with a can having a bail as recited in claim 1, wherein said support lip is L-shaped, including a forwardly-directed portion and an upwardly-directed portion for hooking around the bottom edge of a can.

8. A carrier for use with a can having a bail as recited in claim 1, wherein said hand grip is generally C-shaped and defines a plurality of arcuate recesses for receiving a person's fingers.

9. A method for carrying a can having a bail, comprising the steps of:

placing the front face of a carrier against the side of the can, with a hooked bottom portion of the carrier engaging the bottom edge of the can;

sliding the bail downwardly along the rear face of the carrier, passing over stepped ramps on the rear face until the engagement of the bail with a step causes the can to be tightly seated against the hooked bottom portion of the carrier; and then grasping a hand grip on said carrier and lifting the carrier to pick up the can, wherein said hand grip projects forwardly above the front face of the carrier.

* * * * *